United States Patent [19]

Nelson

[11] Patent Number: 4,934,522

[45] Date of Patent: Jun. 19, 1990

[54] CONVERTIBLE SELF-ADHERING DISPLAY SHELF

[75] Inventor: LeRoy O. Nelson, Minnetonka, Minn.

[73] Assignee: Media/Graphics, Inc., Minneapolis, Minn.

[21] Appl. No.: 419,023

[22] Filed: Oct. 10, 1989

[51] Int. Cl.[5] ..... A47B 96/06

[52] U.S. Cl. ..... 206/44 R; 248/205.2; 211/90

[58] Field of Search ..... 206/44 R, 45, 45.14; 248/205.2; 211/153, 135, 42, 126, 90, 88

[56] References Cited

U.S. PATENT DOCUMENTS

| | | | |
|---|---|---|---|
| 3,437,214 | 4/1969 | Sainsburg | 211/90 |
| 4,376,521 | 3/1983 | Walters | 211/90 X |
| 4,603,781 | 8/1986 | Ryan, Jr. | 211/90 |
| 4,720,069 | 1/1988 | Bessinger | 211/90 X |
| 4,780,349 | 10/1988 | Gieske et al. | 248/205.2 X |
| 4,863,127 | 9/1989 | Handler | 248/205.2 |

*Primary Examiner*—Paul T. Sewell
*Assistant Examiner*—Jacob K. Ackun, Jr.
*Attorney, Agent, or Firm*—Burd, Bartz & Gutenkauf

[57] ABSTRACT

A convertible display shelf for use in conjunction with temporary vertical display panels such as are in widespread use at conventions, trade shows, and similar exhibitions. It is convertible in the sense that it may be arrayed in a downwardly extending angular position for display of sales literature and the like, or, alternatively, in a horizontal flat position for display of products or other three-dimensional goods. The same shelf, without alteration, is capable of use in either of the two alternative function positions. It is characterized by the capability to be knocked down to its generally flat components for compact easy carrying and storage. The shelf is readily assembled and disassembled, and attached to and detached from a display panel without the need of tools. The shelf is self-adhering to cloth covered display panels by means of interlocking filamenary fastening material.

11 Claims, 4 Drawing Sheets

CONVERTIBLE SELF-ADHERING DISPLAY SHELF

BACKGROUND OF THE INVENTION

Field of the Invention

This invention relates to a convertible self-adhering display shelf for use in conjunction with temporary vertical display panels such as are in widespread use at conventions, trade shows, and similar exhibitions. The shelf is self-adhering to cloth covered display panels. It is convertible in the sense that it may be arrayed in a downwardly extending angular position for display of sales literature and the like, or, alternatively, in a horizontal flat position for display of products or other three-dimensional goods. It is characterized by its capability to be knocked down to its generally flat components for compact easy carrying and storage. The shelf is readily assembled and disassembled, and attached to and detached from a display panel without the need of tools. The same shelf, without alteration, is capable of use in either of the two alternative function positions.

SUMMARY OF THE INVENTION

Broadly stated, the invention is directed to a self-adhering, temporary, readily assembled and disassembled, two-way alternate use display shelf, for use in association with vertical fabric surfaced display panels and readily engageable with and disengageable therefrom. The shelf comprises a pair of mirror image right triangular brackets supporting a planar shelf member. Each bracket has one of several alternative means along the outer edge of a firs right angle leg for securely engaging and supporting the planar shelf member. Each bracket has a strip of interlocking filamentary fastening material extending along and firmly secured to the outer edge of the other right angle leg and the hypotenuse of the triangular bracket. The planar shelf member has opposite parallel edges and is of a width substantially equal to the first of the right angle bracket legs. A right angle first lip extends upwardly along one parallel edge of the shelf member and a second lip extends downwardly from the opposite parallel edge of the shelf member in the opposite direction from the first lip and at an angle parallel to the hypotenuse of the bracket when the shelf is assembled. A strip of interlocking filamentary fastening material extends along and is firmly secured to the outer surfaces of each of the first and second lips.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
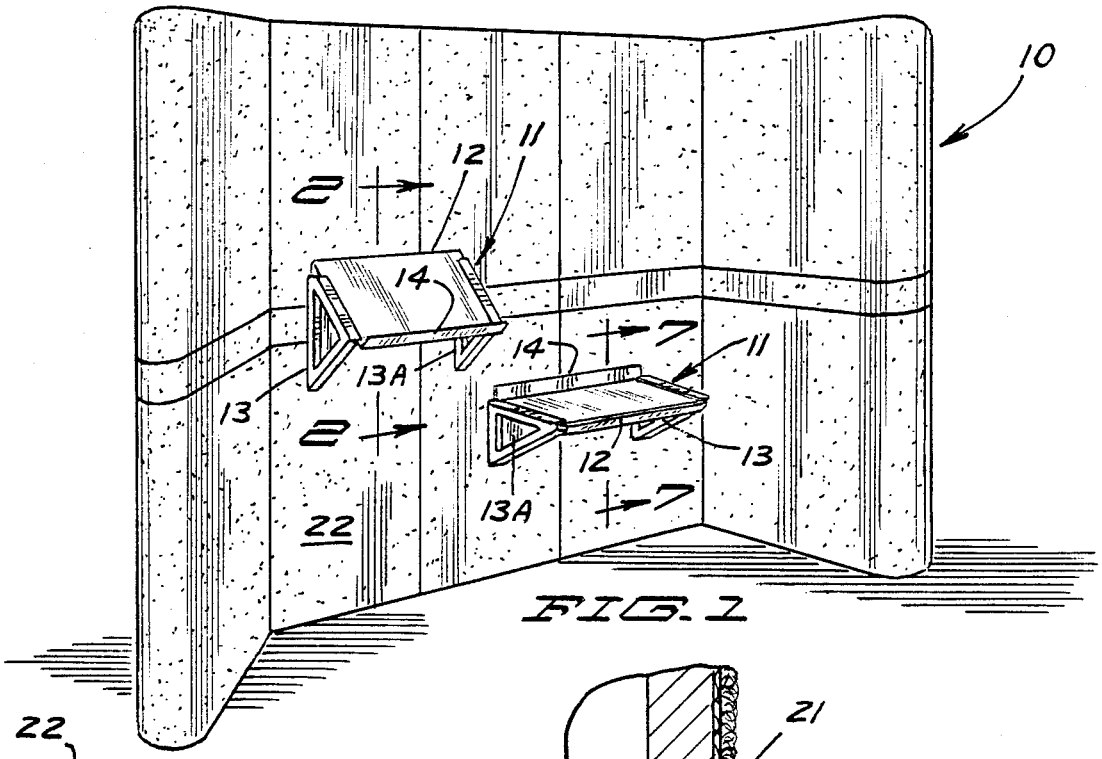
FIG. 1 is a perspective view of a temporary display showing the shelf of the present invention supported thereon in each of its use modes.

Referring now to the drawings, and particularly to FIG. 1, there is shown a temporary display indicated generally at 10 and composed of flat display panels in conjunction with three-dimensional arcuate surface display members, such as is the subject of my copending application Ser. No. 329,402, filed Mar. 29, 1989, which is typical of the temporary displays with which the convertible display shelf of the present invention may be used. The convertible shelf according to the present invention, indicated generally at 11, is shown adhered to the display 10 in each of its functional modes, sloping for the display of literature and level for the display of product. The shelves 11 may be changed from one use mode to the other without disassembly, simply by detaching the shelf from the display panel, rotating it through 180° and reattaching to the panel.

Each display shelf 11 is comprised essentially of three parts, a planar shelf member 12 and a pair of generally right triangular brackets 13 and 13A, which are mirror immages of one another. Shelf 12 is generally rectangular in configuration and is provided with a first right angle lip 14 extending upwardly along one parallel edge and a second lip 15 along the opposite parallel edge. Lip 15 extends downwardly from the surface of the shelf in the opposite direction from lip 14 and at an angle parallel to the hypotenuse of the brackets when the shelf is assembled.

A strip of interlocking filamentary fastening material 16 of the type sold under the trademarks VELCRO and SCOTCHMATE is firmly secured to the outer surface of lip 14 to assist in adhering the shelf assembly to the display panel in the product display mode. A similar strip of fastening material 17 is firmly secured to the outer surface of lip 15 for assisting in securing the shelf assembly to the display panel in the literature display mode.

Shelf 12 is desirably formed from rigid lightweight commercially available synthetic resinous plastic sheet material. It may be transparent or opaque, as desired, and may be of a color complementary to or contrasting with the color of the display with which the shelf assembly is used.

Figure 4:
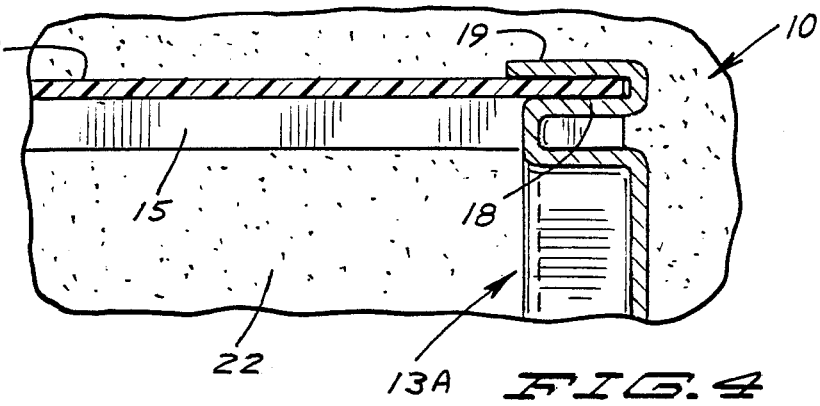
FIG. 4 is a sectional view on the line 4–4 of FIG. 2 and in the direction of the arrows and showing one means of engagement between the planar shelf member and supporting brackets.

The generally right triangular brackets 13 and 13A may be in the form of isosceles or non-isosceles triangles. One right angle leg of each bracket has shelf engaging means in the form of an inwardly facing channel 18 formed in part by an outer lip 19 for engaging the end edges of the shelf member 12, as best seen in FIG. 4.

Figure 3:
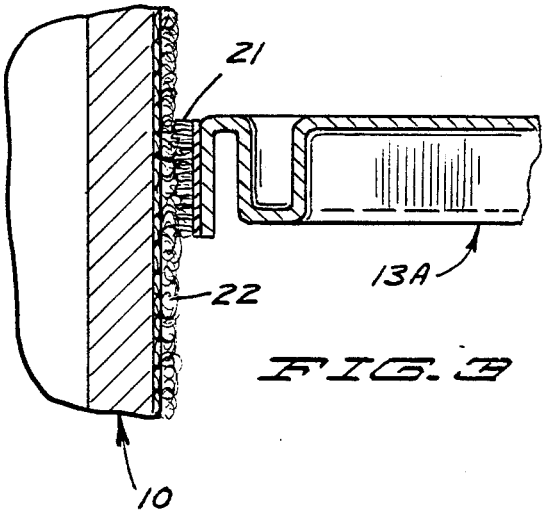
FIG. 3 is a section on the line 3—3 of FIG. 2 and in the direction of the arrows.

Shelf 12 is securely held by frictional engagement in channels 18 of the respective brackets in either the literature display mode or product display mode of the shelf assembly. As seen in FIG. 3, similar channels and lips are formed in the other legs of the brackets, in part to provide additional strength to the brackets. For ease in transport and storage, the brackets are desirably generally flat and lightweight and formed, for example, by molding from synthetic resinous plastic material.

Figure 2:
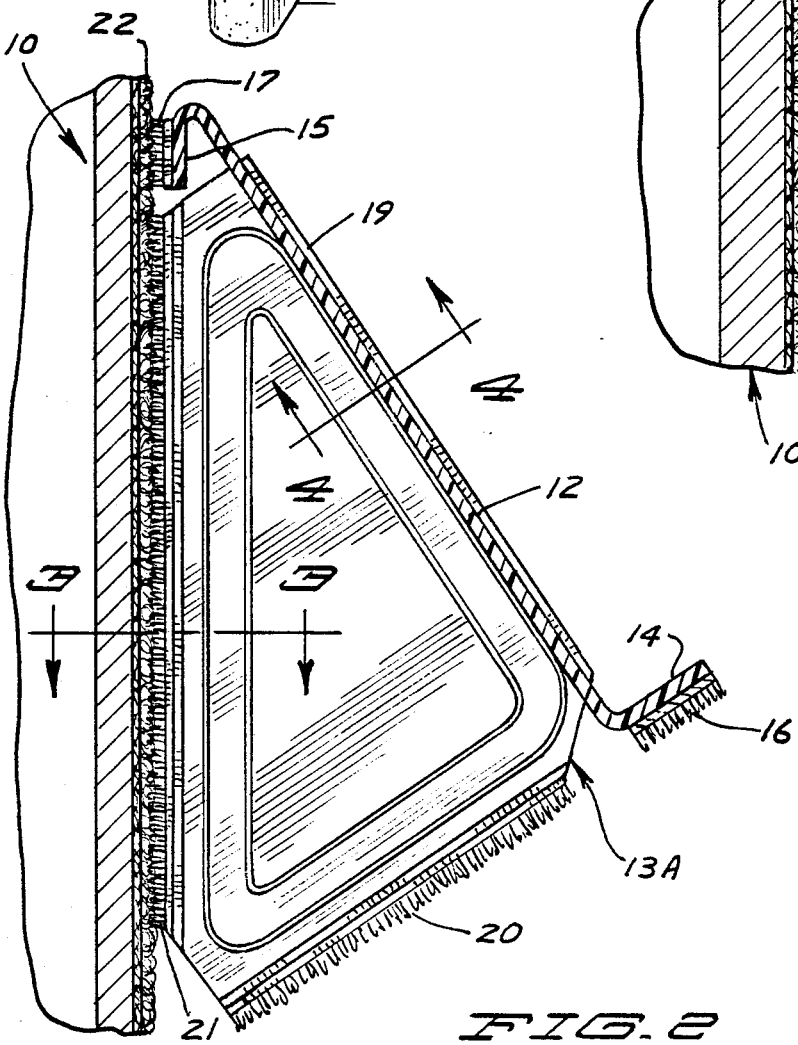
FIG. 2 is a section on an enlarged scale on the line 2—2 of FIG. 1 and in the direction of the arrows.

A strip of filamentary fastening material 20 is firmly secured to the outer edge of the other right angle leg of each bracket and a similar strip of fastening material 21 is firmly secured to the outer edge of the hypotenuse of each bracket. As seen from FIG. 2, for example, fastening strip 17 secured to shelf lip 15 and fastening strips 21 secured to the hypotenuses of the brackets are in alignment and lie generally in a common plane.

Figure 7:
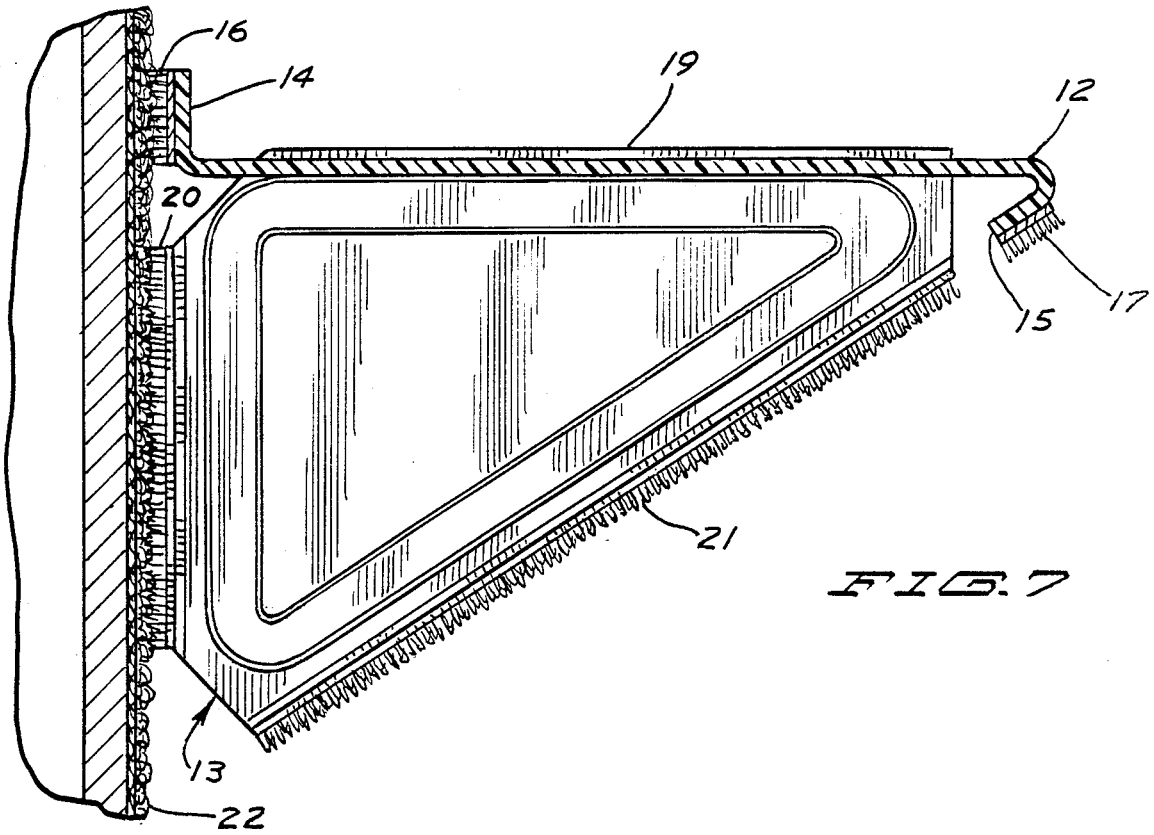
FIG. 7 is a section on an enlarged scale on the line 7—7 of FIG. 1 and in the direction of the arrows and showing one means of engagement between the planar shelf member and bracket.

The surface of display 10 is cloth covered, preferably with looped fabric 22 for firm engagement between the preferred hook-type fastening strips of the shelf assembly and the display panel surface. Similarly, for adhering the shelf assembly to the display 10 in the product display mode, it will be noted that the fastening material 16 on the outer edge of shelf lip 14 and the fastening material 20 on the outer edges of the right angle leg of the brackets are in alignment and lie generally in a common plane for adherence of the shelf assembly to the display panel, as shown in FIG. 7. If the surface to which the shelf is to be attached is smooth or otherwise non-adhering to the fastening strips of the shelf, complementary mating strips of filamentary fastening material may be firmly secured to the panel surface.

Figure 5:
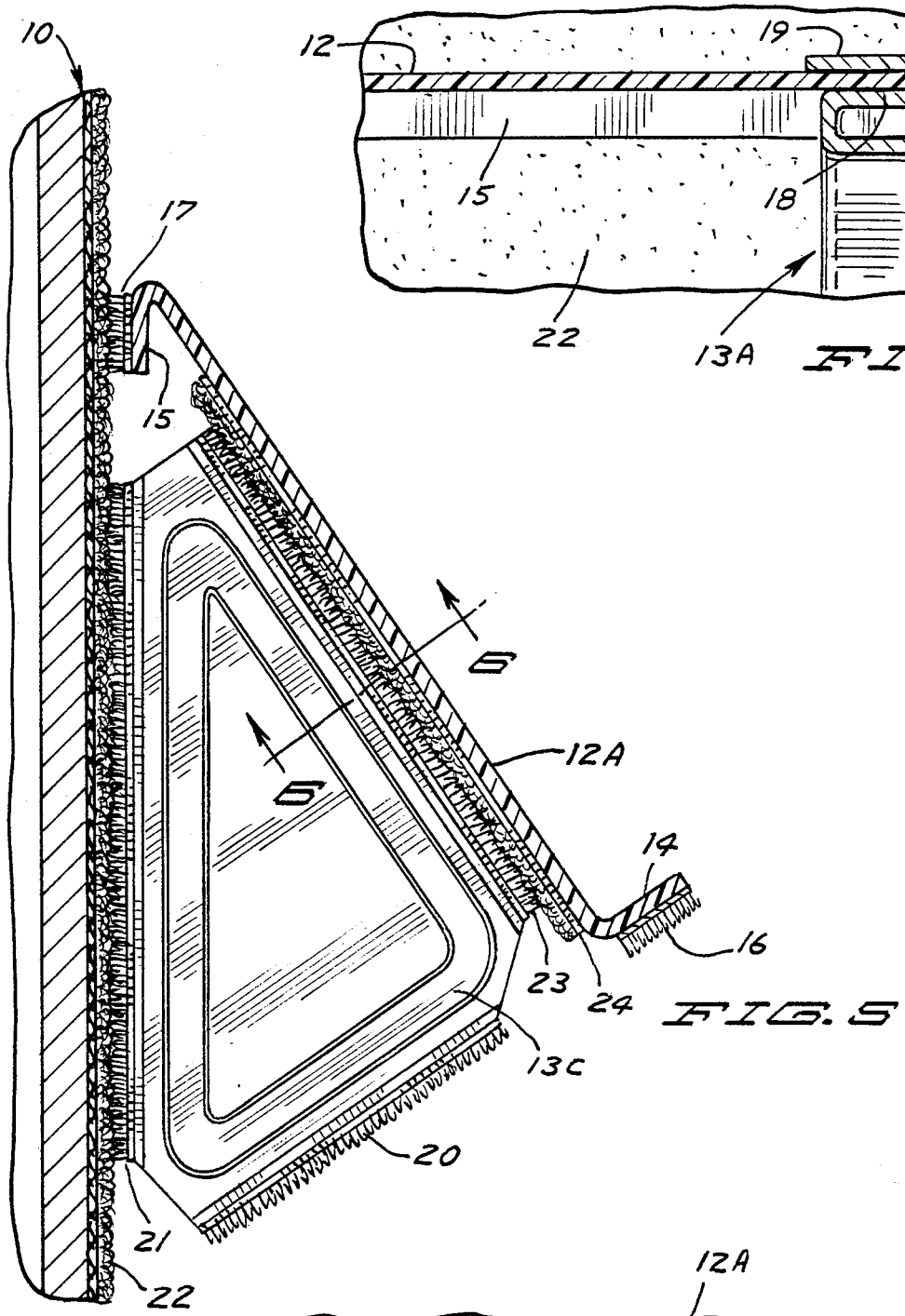
FIG. 5 is a sectional view similar to FIG. 2 but showing an alternative means of engagement between the planar shelf member and bracket.
Figure 6:
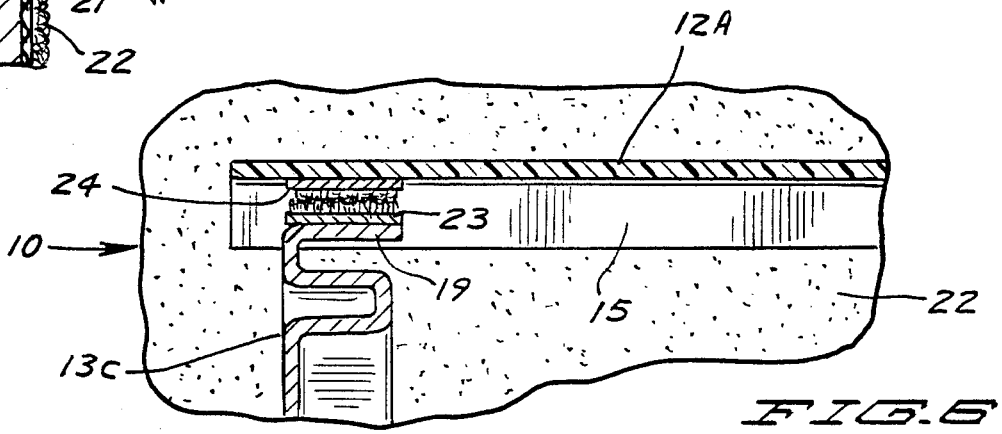
FIG. 6 is a section on the line 6—6 of FIG. 5 and in the direction of the arrows.
Figure 8:
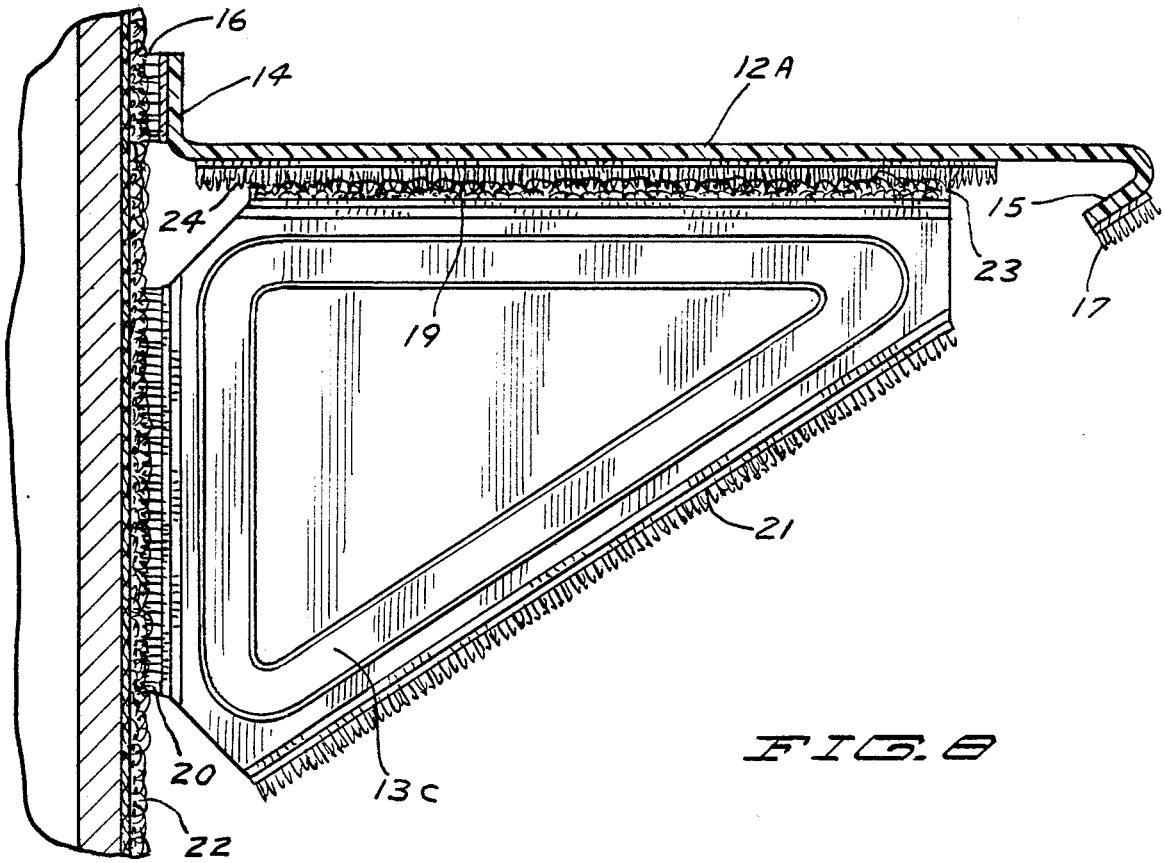
FIG. 8 is a similar fragmentary sectional view showing an alternative means of engagement between the shelf member and bracket.

Referring to FIGs. 5, 6 and 8, there is shown an alternative means for securing the shelf member 12A to triangular brackets 13C. According to this form of the invention, a strip of filamentary fastening material is securely attached to the outer edge of the shelf supporting right angle leg of the bracket 12C, on the outer surface of lip 19. Corresponding strips of filamentary fastening material 23 are disposed transversely on the bottom side of shelf member 12A. Fastening strips 23 may be disposed immediately adjacent to the end edges of the shelf member, or may be spaced inwardly therefrom, as shown in FIG. 6. Where additional strength is needed, this form of shelf assembly permits the use of one or more additional brackets between the end brackets. Fastening strips 22 and 23 readily engage to securely hold the shelf on the brackets.

Figure 9:
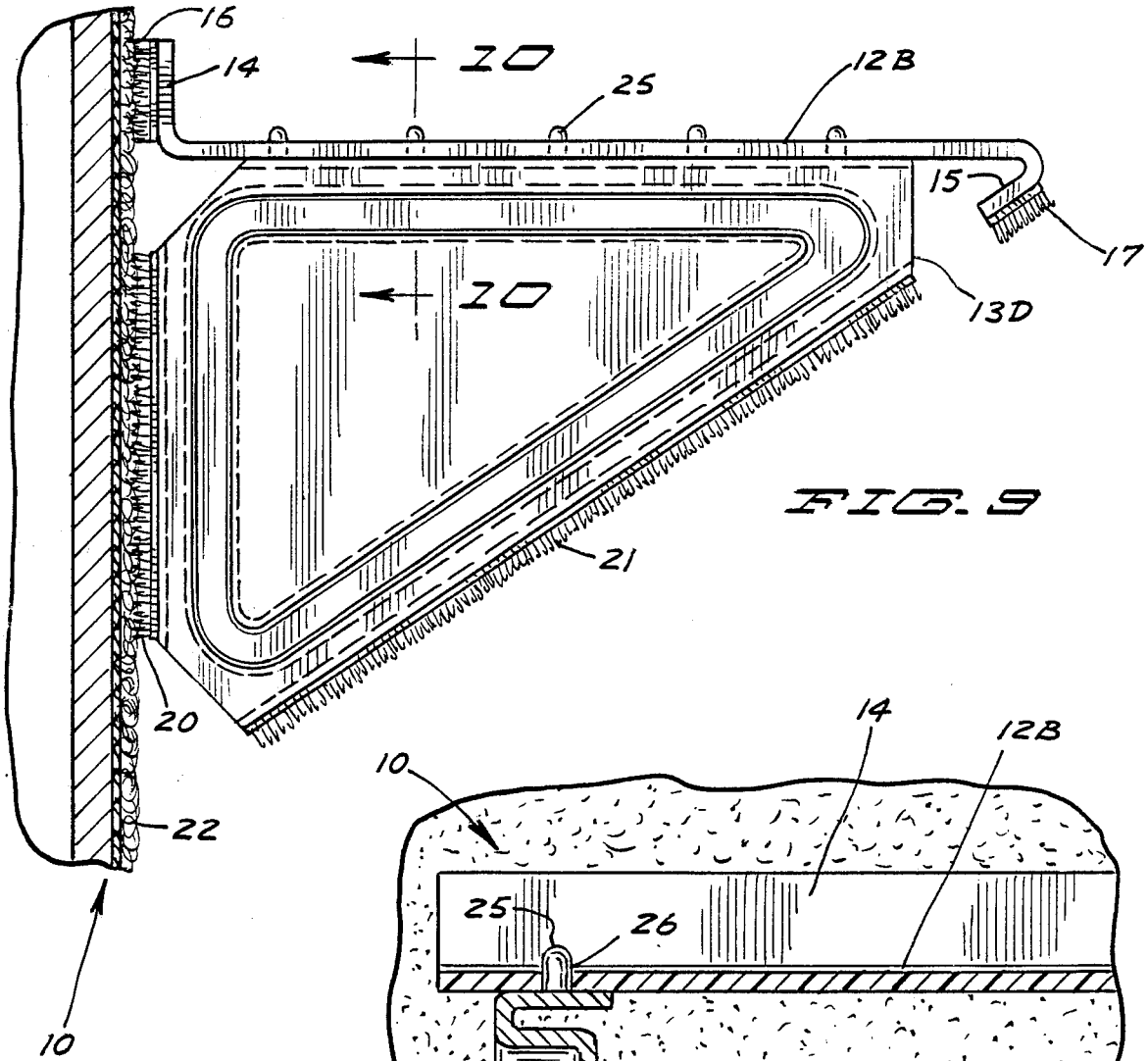
FIG. 9 is a similar sectional view showing a further alternative means of engagement between the shelf member and bracket.
Figure 10:
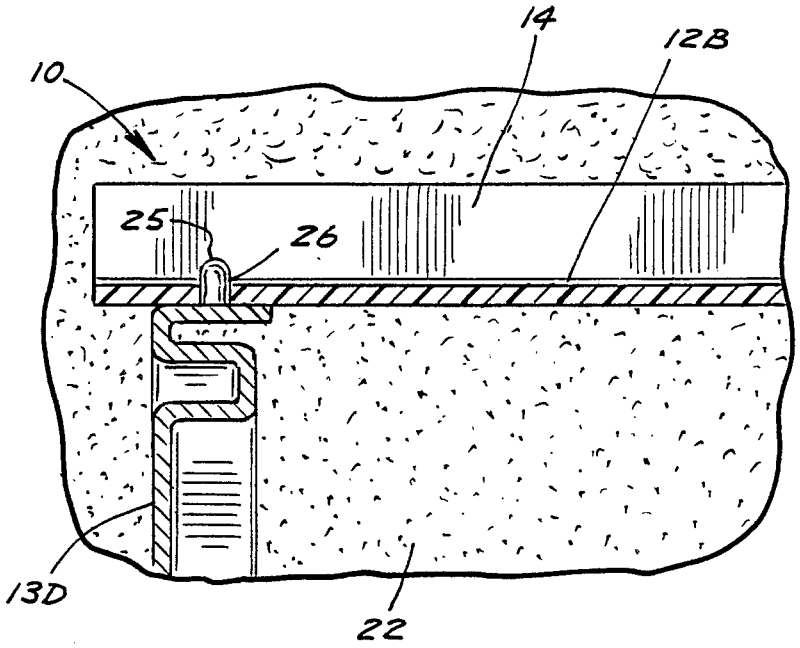
FIG. 10 is a section on the line 10—10 and in the direction of the arrows.

Referring to FIGS. 9 and 10, there is shown another alternative means of attaching shelf member 12B to brackets 13D. According to this form of the invention, the shelf-engaging right angle leg of the triangular bracket is provided with a plurality of projections 25 which engage correspondingly spaced openings in shelf 12B to permit the shelf and brackets to be snapped together in secure engagement. This form of engagement between the shelf and brackets likewise permits the use of additional supporting brackets if needed and permits the ends of the shelves to be other than parallel. In all other respects, both alternative forms of convertible shelf assemblies are attached to a display panel in the manner previously described in detail.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A self-adhering, temporary, readily assembled and disassembled,, two-way alternate use display shelf, for use in association with vertical fabric surfaced display panels and readily engageable with and disengageable therefrom, which shelf comprises:

(A) a pair of mirror image right triangular brackets, each having:

(1) means along the outer edge of a first right angle leg of the bracket for securely engaging and supporting a planar shelf member, (2) a strip of interlocking filamentary fastening material extending along and firmly secured to the outer edge of the other right angle leg of the bracket, and (3) a further strip of interlocking filamentary fastening material extending along and firmly secured to the outer edge of the hypotenuse of the bracket, and (B) a planar shelf member, said member having:

(1) opposite parallel edges and being of width substantially equal to the first of said right angle bracket legs, and (2) a right angle first lip extending upwardly along one parallel edge.

2. A display shelf according to claim 1 wherein said planar shelf member includes a second lip along the opposite parallel edge of said first lip extending downwardly from the surface of the shelf in the opposite direction from said first lip and at an angle parallel to the hypotenuse of the bracket when the shelf is assembled.

3. A display shelf according to claim 2 wherein a strip of interlocking filamentary fastening material extends along and is firmly secured to the outer edge of said second lip.

4. A display shelf according to claim 1 wherein a strip of interlocking filamentary fastening material extends along and is firmly secured to the outer edge of said first lip.

5. A display shelf according to claim 1 wherein:

(A) said planar shelf member is rectangular with parallel end edges, and (B) said means for engaging and supporting a shelf member include in each of said brackets an inwardly facing longitudinal groove or channel extending along the edge of said first right angle leg of each bracket, said groove or channel frictionally engaging the end edges of the shelf member.

6. A display shelf according to claim 1 wherein said means for engaging and supporting a shelf member include:

(A) a strip of interlocking filamentary fastening material extending along and firmly secured to the outer edge of the first of said right angle legs of said brackets, and (B) a further strip of interlocking filamentary fastening material on the underside of said shelf member adjacent to the ends thereof and perpendicular to the opposite parallel edges.

7. A display shelf according to claim 1 wherein said means for engaging and supporting a shelf member include:

(A) a plurality of linearly aligned spaced apart projections extending from the outer edge of the first of said right angle legs of said brackets, and (B) a plurality of similarly aligned and spaced apart openings in said shelf member engageable with said projections.

8. A self-adhering, temporary, readily assembled and disassembled, two-way alternate use display shelf, for use in association with vertical fabric surfaced display panels and readily engageable with and disengageable therefrom, which shelf comprises:

(A) a pair of mirror image right triangular brackets, each having:

(1) means along the outer edge of a first right angle leg of the bracket for securely engaging and supporting a planar shelf member, (2) a strip of interlocking filamentary fastening material extending along and firmly secured to the outer edge of the other right angle leg of the bracket, and (3) a further strip of interlocking filamentary fastening material extending along and firmly secured to the other edge of the hypotenuse of the bracket, and (B) a planar shelf member, said member having:

(1) opposite parallel edges and being of width substantially equal to the first of said right angle bracket legs, (2) a right angle first lip extending upwardly along one parallel edge, (3) a strip of interlocking filamentary fastening material extending along and firmly secured to the outer surface of said first lip, (4) a second lip along the opposite parallel edge, said second lip:

(a) extending downwardly from the surface of the shelf member in the opposite direction from said first lip, and (b) extending at an angle parallel to the hypotenuse of the bracket when the shelf is assembled, and (5) a further strip of interlocking filamentary fastening material extending along and firmly secured to the outer surface of said second lip.

9. A display shelf according to claim 8 wherein:

(A) said planar shelf member is rectangular with parallel end edges, and (B) said means for engaging and supporting a shelf member include in each of said brackets an inwardly facing longitudinal groove or channel extending along the edge of said first right angle leg of each bracket, said groove or channel frictionally engaging the end edges of the shelf member.

10. A display shelf according to claim 8 wherein:

(A) said planar shelf member is rectangular with parallel end edges, and (B) said means for engaging and supporting a shelf member include:

(1) a strip of interlocking filamentary fastening material extending along and firmly secured to the outer edge of the first of said right angle legs of said brackets, and (2) a further strip of interlocking filamentary fastening material on the underside of said shelf member, said fastening material being disposed parallel to the end edges of the shelf member.

11. A display shelf according to claim 8 wherein said means for engaging and supporting a shelf member include:

(A) a plurality of linearly aligned spaced apart projections extending from the outer edge of the first of said right angle legs of said brackets, and (B) a plurality of similarly aligned and spaced apart openings in said shelf member engageable with said projections.

* * * * *